US007419360B2

(12) United States Patent
Chatel et al.

(10) Patent No.: US 7,419,360 B2
(45) Date of Patent: Sep. 2, 2008

(54) ROTOR DISK FOR A TURBOMACHINE

(75) Inventors: Alain Jean Charles Chatel, Vaux le Penil (FR); Laurent Gilles Dezouche, Le Coudray-Montceau (FR); Philippe Joly, Vaux le Penil (FR)

(73) Assignee: SNECMA, Paris (FR)

( * ) Notice: Subject to any disclaimer, the term of this patent is extended or adjusted under 35 U.S.C. 154(b) by 492 days.

(21) Appl. No.: 11/187,852

(22) Filed: Jul. 25, 2005

(65) Prior Publication Data

US 2006/0024167 A1 Feb. 2, 2006

(30) Foreign Application Priority Data

Jul. 28, 2004 (FR) ..... 04 08337

(51) Int. Cl.
*F01D 5/32* (2006.01)

(52) U.S. Cl. ..... 416/215; 416/218; 416/221

(58) Field of Classification Search ..... 416/215–218, 416/219 R, 220 R, 221, 248
See application file for complete search history.

(56) References Cited

U.S. PATENT DOCUMENTS 3,383,094 A * 5/1968 Diggs ..... 416/221
3,902,824 A * 9/1975 Sauer ..... 416/215
4,462,756 A * 7/1984 Muggleworth et al. ..... 416/215
4,818,182 A * 4/1989 Bouru ..... 416/215
4,980,241 A * 12/1990 Hoffmueller et al. .... 416/219 R
5,460,489 A * 10/1995 Benjamin et al. ..... 416/248
6,152,698 A * 11/2000 Gregg et al. ..... 416/215
6,471,483 B2 * 10/2002 London ..... 416/215

FOREIGN PATENT DOCUMENTS

FR 1 541 373 10/1968
FR 2 519 073 7/1983
FR 2 616 480 12/1988

* cited by examiner

*Primary Examiner*—Christopher Verdier
(74) *Attorney, Agent, or Firm*—Oblon, Spivak, McClelland, Maier & Neustadt, P.C.

(57) ABSTRACT

A rotor disk for a turbomachine, the disk carrying blades whose roots are retained in a peripheral groove of the disk, the groove including a window for inserting blade roots and a locking member that is a single elastically deformable piece and dimensioned to be received and retained in a notch of the groove while in its free state, and to be capable of being displaced to slide inside the groove while in a stressed and elastically deformed state.

12 Claims, 2 Drawing Sheets

ROTOR DISK FOR A TURBOMACHINE

The present invention relates to a rotor disk for a turbomachine, the disk being of the type comprising an outer cylindrical surface formed with a peripheral groove in which the roots of the blades of the disk are retained.

BACKGROUND OF THE INVENTION

The blade roots are inserted into the disk groove via a window formed in said groove, and they are held radially and axially relative to the axis of the turbomachine by having co-operating shapes, the groove having a cross-section that is of dovetail-shape, or the like, for example.

In order to prevent the blade roots from sliding freely in the groove of the disk and escaping therefrom through the above-mentioned window, a locking member is inserted through said window into the groove in the disk for the purpose of being displaced within the groove by sliding until it reaches a retaining notch formed in the groove.

Document FR-A-2 810 366 discloses locking members each comprising a radial screw with a head disposed between two blade roots and bearing against the bottom of the groove. Tightening the screw enables the locking member to be displaced radially outwards and enables it to be held in place in the above-mentioned notch in the groove so as to lock the blades in the groove in the disk.

The blade roots are generally mounted with a certain amount of clearance in the peripheral groove of the disk. When the turbomachine is in operation, the blades are subjected to high levels of centrifugal force and to vibration that can lead to the screws of the locking member loosening or jamming.

One solution to that problem consists in deforming the portion of the locking member that receives the screw so as to prevent it from turning. Nevertheless, such deformation by compression is difficult or impossible to achieve when the pitch between the blades is small and hinders or prevents a compression tool being put into place.

It has also been found that such jamming of the screws makes it impossible to disassemble the locking members, thereby making it necessary to destroy them with a drill, and that runs the risk of damaging the rotor disk.

Documents FR-A-2 616 480 and FR-A-1 541 373 also disclose devices for locking the roots of blades, which devices are elastically deformable U- or Ω-shaped parts with their openings directed towards the opening in the groove, and these members have their free ends moved towards each other by means of a suitable tool for the purpose of clamping these parts onto themselves and causing them to slide along the groove into predetermined locking positions. It is not always easy to get hold of the ends of these parts and to clamp them together by means of the tool so as to enable the parts to be slid along the groove into their locking zones, and as a general rule, it is even more difficult to move them in the opposite direction for the purpose of unlocking the blade roots and disassembling the blades.

OBJECTS AND SUMMARY OF THE INVENTION

A particular object of the invention is to provide a solution to the problem that is simple, inexpensive, and effective.

To this end, the invention provides a rotor disk for a turbomachine, the disk carrying blades whose roots are engaged in and retained in an outer peripheral groove of the disk, said groove including an insertion window for inserting the roots of the blades, and at least one retaining notch for retaining a one-piece locking member that is elastically deformable and of U- or Ω-shape, corresponding to the cross-sectional shape of the groove, which member is inserted in the groove via the window and is dimensioned so as to be received and retained in the notch when in the free state substantially without stress or with little stress, and to be movable by sliding along the groove when in an elastically deformed and stressed state, wherein the opening of the locking member faces towards the bottom of the groove when the locking member is mounted in the groove.

The invention presents numerous advantages. The locking member comprises a single piece and is therefore simpler and less expensive than certain locking members of the prior art. Any risk of locking screws jamming is avoided, as are risks of improper mounting due to failure to tighten a screw properly.

In addition, the disk has only one type of blade, since there is no longer any need to mount special blades on either side of the locking member, these special blades in the prior art being shaped to allow the tightening screws to be put into place and tightened.

In addition, because the opening of the locking member faces towards the bottom of the groove, it is possible to tighten them by applying pressure without requiring a special tool.

In a preferred embodiment of the invention, the locking member comprises a metal strip that is folded or bent so as to take up the shape of the cross-section of the groove and that is made out of a steel that withstands high temperatures, for example a nickel chromium alloy.

The locking member has a central portion and two lateral flanges or tongues interconnected by the central portion, together with a metal plate that is secured, e.g. by crimping, to the radially outer face of said central portion, said metal plate being of a shape that is complementary to the shape of the retaining notch.

The locking member can then be deformed elastically by pressing against its central portion, which pressure can be exerted radially inwards through the opening in the groove so as to move the plate radially towards the bottom of the groove.

The retaining notch formed in the above-mentioned groove has two cavities formed facing each other in the side walls of the groove and serving to receive the edges of the plate, which edges engage in the cavities by moving radially outwards when the locking member relaxes elastically, thereby preventing said member from moving in the groove of the disk. The two cavities open out radially into the cylindrical surface of the disk in which the groove is formed.

The invention also provides a turbojet compressor including at least one rotor disk as described above, and also provides a turbomachine such as a turbojet, including at least one rotor disk as described above.

BRIEF DESCRIPTION OF THE DRAWINGS

Other advantages and characteristics of the invention will appear on reading the following description made by way of non-limiting example and with reference to the accompanying drawings, in which.

MORE DETAILED DESCRIPTION

Figure 1:
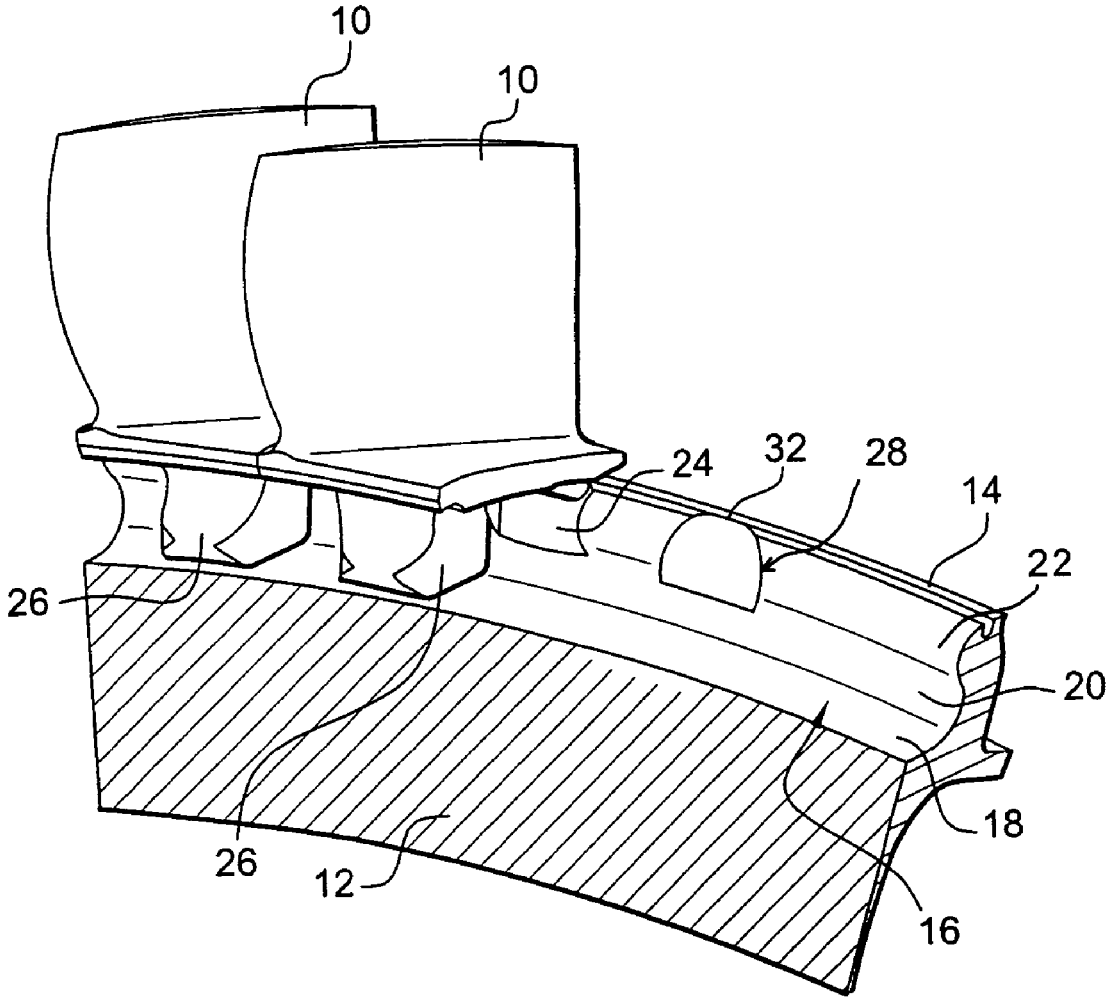
FIG. 1 is a fragmentary diagrammatic perspective view of the groove in a disk for receiving the locking member of the invention.

FIG. 1 shows a disk 12 of a turbomachine rotor, in particular of a high pressure or low pressure compressor of a turbojet, the disk 12 having at its outer periphery a cylindrical surface 14 in which there is formed a groove 16 that is open radially outwards.

In conventional manner, this groove 16 has a cross-section that is dovetail-shaped, Christmastree-shaped, or the like. The groove 16 in the disk 12 in the example shown has an annular bottom wall 18 that is substantially flat and two side walls 20 each carrying an axially-directed rim 22 on its radially outer portion extending towards the opposite side wall 20, with the opening of the groove 16 being narrower than its bottom 18.

The groove includes a window 24 for inserting the roots 26 of the blades 10 of the disk 12, which roots are complementary in shape to the groove 16.

The window 24 is formed by cutting through the above-mentioned rims 22 of the side walls 20 of the groove 16 over a length of circumferential dimension that is slightly greater than that of a blade root, so as to enable it to be inserted into the window 24 by moving in translation radially from outside the groove.

The groove 16 also has at least one notch 28 for retaining a locking member of the invention for locking the roots 26 of the blades in the groove 16 of the disk 12. The notch 28 is formed by two cavities 32 that are cut out facing each other in the rims 22 of the groove 16 and that open radially to the cylindrical surface 14 of the disk on the outside of the groove.

Figure 2:
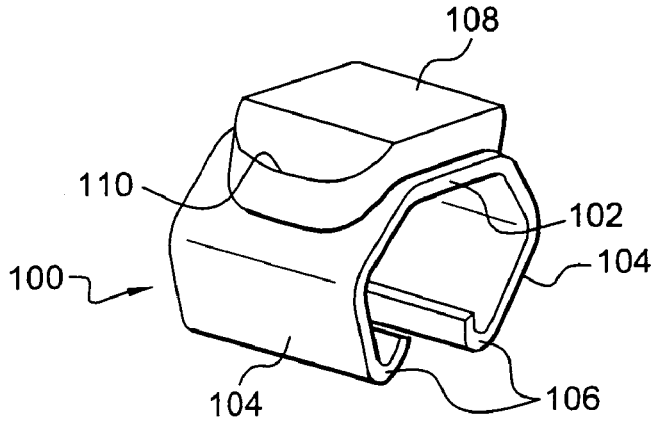
FIG. 2 is a diagrammatic perspective view of the locking member of the invention.
Figure 3:
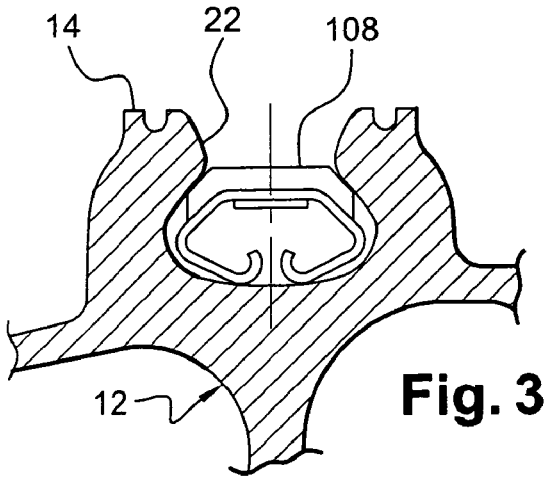
FIG. 3 is a fragmentary diagrammatic cross-section view showing the locking member of the invention mounted in the peripheral groove of a disk.
Figure 4:
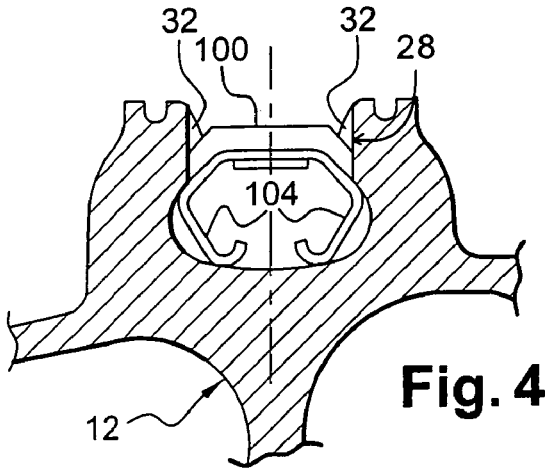
FIG. 4 is a fragmentary diagrammatic cross-section view showing the locking member of the invention engaged in a retaining notch of the groove of the disk.

The locking member 100 shown in FIGS. 2 to 4 is made as a single piece and comprises a metal strip folded or bent substantially into an Ω-shape with the opening in the Ω-shape facing towards the bottom 18 of the groove 16 in the disk 12 when the member 100 is inserted in the groove 16.

The locking member 100 has a central portion 102 that is substantially plane and two lateral flanges or tongues 104 that are connected to the central portion 102 and folded into a wide open V-shape, with the vertices of the V-shapes being further apart than the ends of the tongues, which bear against the bottom 18 of the groove via rims 106 that are curved in the form of circular arcs.

The locking member 100 also comprises a metal plate 108 that is fastened, e.g. by crimping, on the radially outer face of the above-mentioned central portion 102. This plate 108 is substantially complementary in shape to the shape of the outside portion of the groove 16, and comprises two sloping lateral branches 110 that are substantially parallel to the inside faces of the rims 22 of the groove 16.

In the free state, the dimensions of the member 100 correspond approximately to those of the notch 28, so that, when in the notch, the member 100 is either free or is prestressed only slightly.

On assembly, the locking member 100 is inserted in the above-mentioned window 24 while in the free state substantially without stress or deformation, and then it is flattened a little by pressing on the central portion 102, with this pressure being exerted radially inwards from the opening in the groove 16 and causing the curved ends of the tongues to slide on the bottom 12 of the groove 16 so as to move towards each other until the side branches 110 of the plate 106 are located radially inside the rims 22 of the groove 16 in the disk 12. The locking member 100 can then be moved in translation inside the groove 16, while in the stress state as shown in FIG. 3.

When the locking member 100 is brought to a notch 28 in the groove 16, the lateral branches of the plate 108 are released from the rims 22 and engaged in the above-mentioned cavities 32 of the notch 28 by moving them radially in translation as the tongues 104 relax elastically. The locking member 100 then returns to a free state or to a lightly stressed state as shown in FIG. 4. It remains stationary in the groove 16 of the disk 12 because the plate 108 is engaged in the notch 28 in the groove 16.

The plate 108 of the locking member 100 may include or form retention means or engagement means for a tool serving to move the member 100 within the groove 16. By way of example, these means may be a radial orifice formed in the plate 108.

The disk 12 includes at least one, and preferably two, retaining notches 28 and two locking members received in said notches.

Blades 10 are mounted on the disk 12 as follows:

- the roots of the blades 10 are inserted one after another in the window 24 and they are moved in translation along the groove 16, with two locking members 100 being interposed between the blade roots, which members are separated from one another by an angular distance corresponding to the angular distance separating their retaining notches 28; and
- the root of the last blade is inserted in the window 24 and the set of blades and locking members is moved in the groove 16 so as to bring the locking members into their notches 28.

When the locking members snap into the notches 28, that ensures that the set of blades is prevented from moving on the disk. In this position, the insertion window 24 extends over two blade roots. The clearance between the blades is sufficient to pass a tool between two adjacent blade roots to act on the locking members and bring them into the stressed state in which they can be moved in translation in the groove 16 for the purpose of removing the blades.

Nevertheless, this clearance is not large enough to enable a blade root to find itself fully within the window 24 when the members 100 are snapped into the notches 28. Typically this clearance is of the order of a few millimeters. The number of blades mounted on a disk is relatively high, possibly lying in the range 90 to 100.

The locking members 100 are made of steel, e.g. spring steel, capable of withstanding high temperatures. Such a steel may be a nickel chromium alloy, for example.

What is claimed is:

1. A rotor disk for a turbomachine, the disk carrying blades whose roots are engaged in and retained in an outer peripheral groove of the disk, said groove including an insertion window for inserting the roots of the blades, and at least one retaining notch for retaining a one-piece locking member that is elastically deformable and of U- or Ω-shape, corresponding to the cross-sectional shape of the groove, which member is inserted in the groove via the window and is dimensioned so as to be received and retained in the at least one notch when in the free state substantially without stress or with little stress, and to be movable by sliding along the groove when in an elastically deformed and stressed state, wherein an opening of the locking member faces towards the bottom of the groove when the locking member is mounted in the groove.

2. A rotor disk according to claim 1, wherein the locking member comprises a central portion and two lateral flanges or tongues connected to said central portion, together with a metal plate secured to the radially outer face of its central portion.

3. A rotor disk according to claim 2, wherein the metal plate is of a shape that is complementary to the shape of the at least one retaining notch.

4. A rotor disk according to claim 2, wherein the locking member is elastically deformed by pressing against its central portion in a radially inwards direction through the window in the groove and displacing said plate radially towards the bottom of the groove.

5. A rotor disk according to claim 4, wherein the at least one retaining notch formed in the above-mentioned groove has two cavities formed facing each other in the side walls of the groove for the purpose of receiving the edges of the above-mentioned metal plate, which plate engages in said cavities by moving radially outwards when the locking member relaxes elastically.

6. A rotor disk according to claim 5, wherein the two above-mentioned cavities open out radially in the cylindrical surface of the disk in which the groove is formed.

7. A rotor disk according to claim 1, wherein the locking member comprises a folded or bent metal strip having the same shape as the cross-section of the groove and made out of a steel that withstands high temperatures.

8. A turbojet compressor including at least one rotor disk according to claim 1.

9. A turbomachine including at least one rotor disk according to claim 1.

10. A rotor disk according to claim 1, wherein the locking member comprises a central portion and two lateral flanges or tongues connected to said central portion, together with a metal plate crimped to the radially outer face of its central portion.

11. A rotor disk according to claim 1, wherein the locking member comprises a folded or bent metal strip having the same shape as the cross-section of the groove and made out of a nickel chromium alloy.

12. A turbojet including at least one rotor disk according to claim 1.

* * * * *